United States Patent [19]

Bennett

[11] Patent Number: 4,700,858

[45] Date of Patent: Oct. 20, 1987

[54] PLASTIC ENCLOSURE HAVING LIVING HINGES

[75] Inventor: Robert A. Bennett, Easton, Conn.

[73] Assignee: Anchor Hocking Corporation, Lancaster, Ohio

[21] Appl. No.: 847,260

[22] Filed: Apr. 2, 1986

[51] Int. Cl.[4] ..... B65D 47/08

[52] U.S. Cl. ..... 215/237; 220/335; 222/498

[58] Field of Search ..... 215/237, 235; 220/335; 222/498, 517, 556

[56] References Cited

U.S. PATENT DOCUMENTS 4,358,032 12/1980 Libit ..... 222/556 X 4,503,991 3/1985 Joyce ..... 215/237 X

*Primary Examiner*—Donald F. Norton

*Attorney, Agent, or Firm*—Stoll, Wilkie, Previto & Hoffman

[57] ABSTRACT

A hollow vertical cyliner is open at its lower end. A deck having an opening communicating with the interior of the cylinder seals the upper end of the cylinder. A cap for the top end has essentially the same shape and size as the top end. The cap has a first relatively small section and a second relatively large section. The first section is secured to a corresponding portion of the top end. The two sections have facing edges which are spaced from each other except for a common central region which defines a second integral living hinge. A prong is secured to the second section and is insertable into and removable out of the opening in the deck.

2 Claims, 8 Drawing Figures

FIG. 1
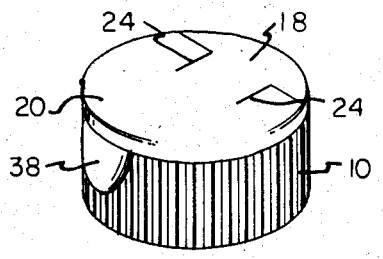
FIG. 2
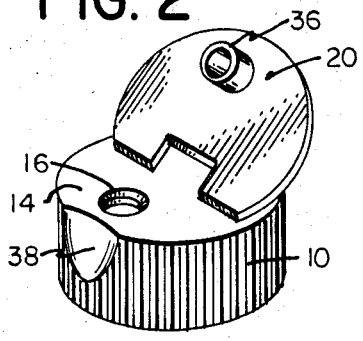
FIG. 3
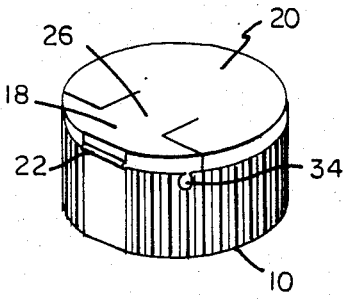
FIG. 4
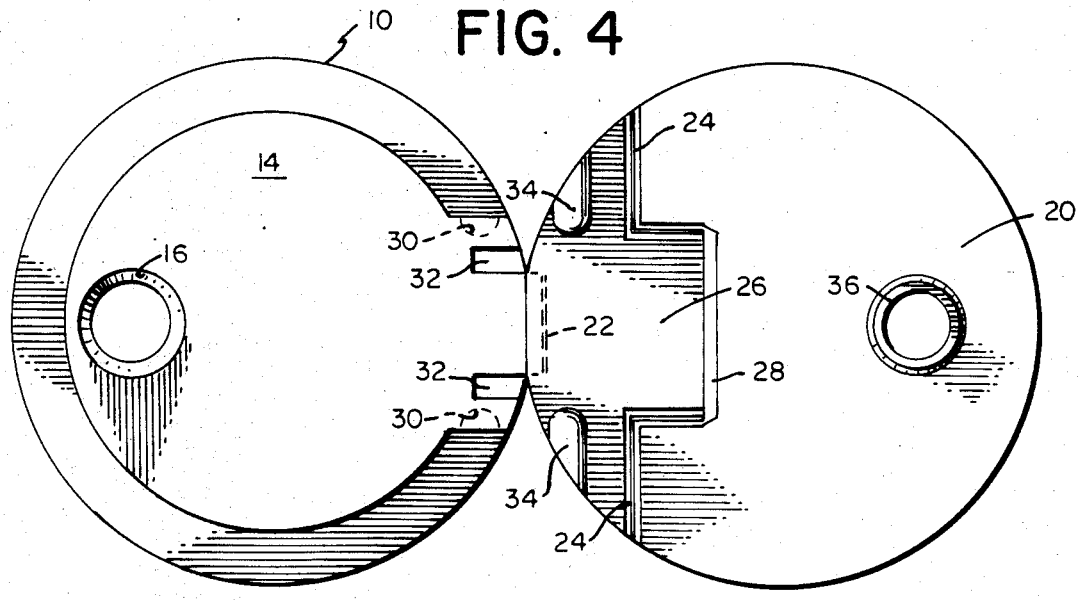
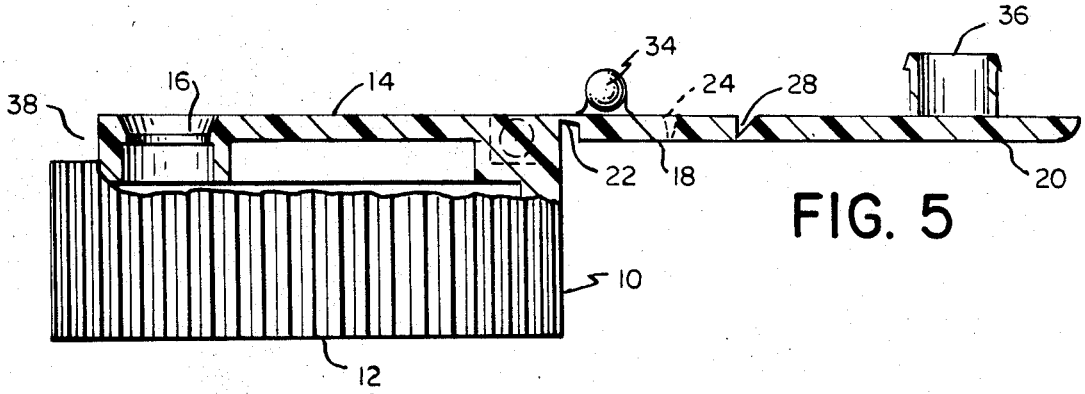
FIG. 5
FIG. 6A
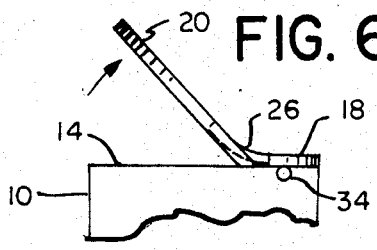
FIG. 6B
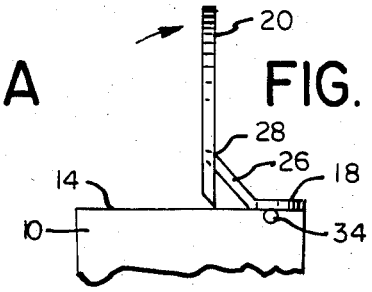
FIG. 6C
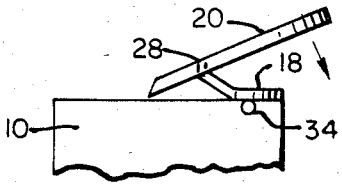

PLASTIC ENCLOSURE HAVING LIVING HINGES

BACKGROUND OF THE INVENTION

U.S. Pat. No. 4,487,324 discloses a plastic enclosure employing a vertical hollow cylinder open at its lower end. The cylinder is snap fitted onto the open neck of a plastic container. A deck with an opening communicating with the open neck closes the upper end of the container. A cap having a sealing stud movable into and out of sealing engagement with the deck is connected to the cylinder by upper hinges as well as by a hinge assembly stap which is hinged to the cap and also hinged to the cylinder. When the enclosure is closed, the cap rests on top of the deck. When the enclosure is opened, the cap must be swung away from the cylinder to expose the entire deck.

The present invention is directed to a new type of plastic enclosure which utilizes fewer hinge connections and which has a cap which can be opened and closed with a snap action that only exposes a portion of the deck.

SUMMARY OF THE INVENTION

In accordance with the principles of this invention, a plastic device is adapted to engage and close the open neck of a container. The device employs a vertical hollow cylinder open at its lower end. A deck seals the upper end of the cylinder and has an opening communicating with the interior of the cylinder.

The device also has a cap which has essentially the same shape and area as the top end, the cap consisting of a first relatively small section and a second relatively large section. The first section is secured along a portion of its periphery to a corresponding portion of the periphery of the top end by a first integral living hinge. The two sections have facing edges which are spaced from each other except for a common central region which defines a second integral living hinge.

First and second interconnecting means on the top end and the first section, disposed adjacent but spaced from opposite sides of the first hinge, secure the first section to the top end. A prong is secured to the second section and extends at right angles thereto.

In use, the cylinder is secured to the open neck of a container. When the device is closed, both cap sections overlie the deck with the prong sealing the opening. In order to open the device, a peripheral edge of the second section, disposed opposite to the first hinge is forced upward, thus causing the first section to pivot about the common central region. As the angle of pivot is increased beyond ninety degrees, the second hinge initiates a snap action which causes the second section to pivot further into an open position overlying the first section. This action moves the prong out of engagement with the opening in the deck and exposes the opening so that the contents of the container can be poured out.

BRIEF DESCRIPTION OF THE DRAWINGS

FIG. 1 is a perspective front view of one embodiment of the invention, showing the device in closed position.

FIG. 2 is a view similar to FIG. 1, showing the device in open position.

FIG. 3 is a rear perspective view of the embodiment shown in FIG. 1.

FIG. 4 is an enlarged top view of another embodiment of the invention shown in FIG. 1.

FIG. 5 is a side view, partially in cross section, of the structure shown in FIG. 4.

FIGS. 6*a*, 6*b* and 6*c* illustrate the action in opening and closing the device.

DETAILED DESCRIPTION OF PREFERRED EMBODIMENTS

Referring now to FIGS. 1–5, the plastic device includes vertical hollow cylinder 10 having open lower end 12. A flat deck 14 seals the upper end of the cylinder and has opening 16 therein which communicates with the interior of the cylinder. A cap having essentially the same shape and size as the top end consists of a first relatively small section 18 and a second relatively large section 20. Section 18 has an exposed periphery coincident with a portion of the periphery of the upper end of the cylinder. Section 18 is secured along a portion of its periphery to a corresponding portion of the periphery of the upper end by an integral living hinge 22. Slots 32 are disposed in the upper end on each side of hinge 22. Sections 18 and 20 have facing edges 24 which are spaced from each other except for a common central region 26 which incorporates a second living hinge 28. The upper end of the cylinder has recesses 30 which are disposed on opposite sides of slots 32 remote from hinge 22 and which are spaced from hinge 28. Section 18 has extensions 34 which snap fit into corresponding recesses 30 after hinge 22 has been folded over whereby section 18 is permanently locked to the upper and and rests on the deck at all times. Section 20 has prong 36 which extends at right angles thereto and can be inserted into sealing engagement with opening 16 when the device is closed and can be swung out of engagement when the device is opened.

The opening and closing actions are shown in FIGS. 6*a*, 6*b* and 6*c*. To open, the user places his finger in finger receiving recess 38 and presses upwardly upon the adjacent peripheral edge of section 20 as shown in FIG. 6*a*. Once section 20 is pivoted past ninety degrees, as shown in FIG. 6*b*, the opening snap action shown in FIG. 6*c* ensues. When the closing action is begun, snap action in closing occurs once the section is pivoted past the ninety degree position.

What is claimed is:

1. A plastic device adapted to engage and close the open neck of a container and comprising:

a vertical hollow cylinder open at its lower end, a deck sealing the upper end of the cylinder, the deck having an opening communicating with the interior of the cylinder;

a cap for the deck having essentially the same shape and area as the deck, the cap consisting of a first relatively small section and a second relatively large section, the first section being fixedly secured to a corresponding portion of the deck, the two sections having facing edges whih are spaced from each other by a common central region which defines an integral living hinge between said first and second sections and said hinge being spaced from said facing edges in a direction away from first section;

a prong secured to the second section and extending at right angles thereto, the prong being insertable into and removable out of the opening in the deck.

2. The device of claim 1 wherein the first section is secured to said deck by interlocking extensions and recesses.

* * * * *